United States Patent [19]

Kiga et al.

[11] 4,208,246

[45] Jun. 17, 1980

[54] METHOD OF PREPARING ASBESTOS DIAPHRAGMS FOR ELECTROLYSIS CELL

[75] Inventors: Shotaro Kiga; Naoshi Yoshida; Kenichi Edahiro, all of Nakago; Tadashi Sakata, Arai, all of Japan

[73] Assignee: Nippon Soda Company Limited, Ohtemachi, Japan

[21] Appl. No.: 879,229

[22] Filed: Feb. 21, 1978

[51] Int. Cl.[2] ..... C25B 13/00

[52] U.S. Cl. ..... 162/106; 162/155; 204/295

[58] Field of Search ..... 162/105, 106, 155, 156, 162/164 EP, 177; 204/295, 296; 428/444

[56] References Cited

U.S. PATENT DOCUMENTS

| | | | |
|---|---|---|---|
| 2,626,213 | 1/1953 | Novak | 162/155 |
| 2,773,114 | 12/1956 | McAuslan | 204/296 |
| 3,723,264 | 3/1973 | Leduc et al. | 204/295 |
| 3,980,613 | 9/1976 | Bachot et al. | 204/296 |
| 4,036,727 | 7/1977 | Patil et al. | 204/296 |
| 4,065,534 | 12/1977 | Rechlicz et al. | 162/155 |
| 4,093,533 | 6/1978 | Beaver et al. | 204/295 |

FOREIGN PATENT DOCUMENTS

| | | | |
|---|---|---|---|
| 631848 | 11/1961 | Canada | 162/156 |
| 2604975 | 8/1976 | Fed. Rep. of Germany | 204/296 |

OTHER PUBLICATIONS

Schwartz, "Surface Active Agents & Detergents", vol. II, (1958), p. 516.

*Primary Examiner*—S. Leon Bashore
*Assistant Examiner*—Peter Chin
*Attorney, Agent, or Firm*—George B. Oujevolk

[57] ABSTRACT

Diaphragms of deposited asbestos which are consolidated by a polymer are prepared by the steps of dispersing a polymer emulsion into asbestos fibers dispersed in an aqueous solution of a cellulose ether or a high molecular weight polyether polyol, depositing the asbestos fiber slurry on a metal screen cathode by means of filtration, and drying the deposited asbestos fibers. The asbestos fibers are deposited evenly on a cathode of commercial size and the diaphragms are consolidated satisfactorily by the polymer.

2 Claims, 1 Drawing Figure

METHOD OF PREPARING ASBESTOS DIAPHRAGMS FOR ELECTROLYSIS CELL

BACKGROUND OF THE INVENTION

The present invention relates to a method of preparing diaphragms of deposited asbestos consolidated by a polymer emulsion, which are used in the electrolysis cells for the production of chlorine and alkali hydroxides.

Numerous methods have been proposed for the preparation of diaphragms of deposited asbestos consolidated by a polymer, and the typical method comprises the step of suspending asbestos fibers and an electrolyte-resistant solid polymer having powder or fiber form in an aqueous suspension medium, the step of depositing the asbestos fibers and the polymer on a metal screen cathode by means of filtration, and the step of heating the depositing layer of asbestos fibers containing the solid polymer at a temperature above the melting point of the polymer. The heating step is required to bind together the asbestos fibers with the melted polymer to result in the consolidation of the diaphragm.

As an improved method of consolidating diaphragms of deposited asbestos with a polymer, a method of employing an emulsion of an electrolyte-resistant polymer is proposed. When the deposited layer of asbestos fibers containing the polymer in a form of dispersed phase is dried to remove the suspension medium, the polymer becomes an adhesive to bind the asbestos fibers. Since the drying step is generally effected at room temperature or a temperature below 100° C., the step is remarkably meritorious when compared with the heating step usually conducted at such high temperatures as 300°–400° C.

In order to achieve an effective consolidation of asbestos diaphragms with a polymer emulsion, it is necessary to make the polymer emulsion disperse homogeneously in the slurry of asbestos fibers and further make the polymer distribute uniformly in the asbestos fibers deposited on a metal screen cathode, since the polymer in the asbestos fibers does not flow during the drying step utterly different from the heating step.

In the commercial operation of the electrolysis, the most widely used suspension medium of asbestos fibers is an aqueous solution of alkali hydroxide. Since a polymer emulsion tends to coagulate in an alkaline water, it is difficult to obtain a homogeneous suspension of asbestos fibers containing a uniformly dispersed polymer emulsion in so far as an alkaline water is used as the suspension medium of asbestos fibers. For overcoming the problem of consolidating the asbestos fibers with a polymer emulsion, a method is proposed in which the deposited asbestos fibers are first washed with water and then the alkali-free asbestos fibers are impregnated with a polymer emulsion. However, the method requires the additional steps of washing with water, and the impregnation.

SUMMARY OF THE INVENTION

It is therefore an object of the present invention to provide a novel and improved method of preparing diaphragms of deposited asbestos consolidated by the use of a polymer emulsion.

It is another object of this invention to provide a method of the type described, whereby said method is carried out with almost the same easiness as the method of preparing unconsolidated diaphragms of deposited asbestos.

It is still another object of this invention to provide a method of the type described, whereby it is possible to obtain diaphragms of deposited asbestos fibers which are applicable to commercial electrolysis cells for the production of chlorine and alkali hydroxide.

A method to which this invention is applicable is for preparing diaphragms of deposited asbestos fibers consolidated by the use of a polymer emulsion, and the method comprises the step of dispersing a polymer emulsion into asbestos fibers suspended in an aqueous suspension medium, and the step of depositing the polymer as well as the asbestos fibers on a metal screen cathode by means of filtration. The suspension medium is an aqueous solution of a cellulose ether or a polyether polyol.

DESCRIPTION OF THE PREFERRED EMBODIMENTS

Figure 1:
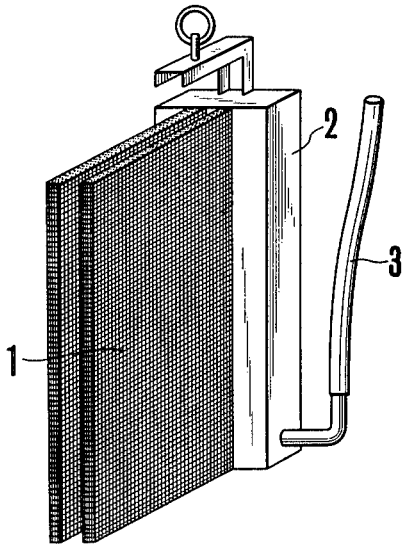
FIG. 1 is a view in oblique of a model metal screen cathode used for testing a method in accordance with this invention.

For the practice of the present method of preparing the asbestos diaphragm, the asbestos fibers used are those commonly utilized in the preparation of diaphragms of deposited asbestos fibers for use in chlorine-alkali electrolysis cells.

The polymer emulsion for consolidation of the asbestos fibers used for the practice of the present method is an emulsion of a polymer which develops a binding between the polymer particle and the asbestos fibers as well as between the polymer particles when the dispersing medium of the polymer emulsion is removed. The polymer emulsions which are preferably employed are, for example, a fluorinated polymer emulsion prepared by an emulsion polymerization of vinylfluoride and hexafluoro propylene in the presence of an emulsifier and a polymerization initiator, and an emulsion of such electrolyte-resistant polymers as polystyrene and polymethylmethacrylate prepared by dispering an organic solution of a polymer in water by the use of a nonionic emulsifier. The polymer emulsion usually has the particle size of less than 5$\mu$, preferably less than 0.5$\mu$, and the polymer content of less than about 30%. The weight ratio of the polymer added to the asbestos fibers is about 5–20%.

The suspension agents for the suspension of asbestos fibers in water characterizing the present invention are water-soluble polymers comprising cellulose ethers such as hydroxyethyl cellulose, hydroxypropyl cellulose, methyl cellulose, ethyl cellulose and carboxymethyl cellulose, and polyether polyols such as high molecular weight polyethylene glycol and polypropylene glycol. As to the polyether polyols, higher polymers are generally recommended for the purpose of suspension, however, decrease in the solubility in water must be considered. Therefore, preferably high molecular weight polyether polyols are those having the molecular weight of more than about 100,000 for polyethylene glycol and about 200–700 for polypropylene glycol. The suspension medium according to the invention generally contain 0.5–10 g of the suspending agent per liter of water. The suspension medium does not cause coagulation of the polymer emulsion, so that when the polymer emulsion is mixed with asbestos fibers suspended homogeneously in the suspension medium, an asbestos fiber slurry containing particles of the polymer dispersed uniformly in the slurry is obtainable.

A conventional method of preparing diaphragms of deposited asbestos fibers consolidated by a polymer emulsion according to the present invention comprises the step of preparing a slurry of asbestos fibers suspended in the suspension medium and mixing a polymer emulsion with the slurry, the step of depositing the polymer particles as well as the asbestos fibers on a metal screen cathode by means of filtration, and the step of drying the layer of deposited asbestos fibers to remove water.

The procedure for preparing diaphragms of deposited asbestos fibers according to the present method is carried out as easily as the conventional method of preparing diaphragms from asbestos fiber slurries. And the asbestos fibers can be deposited evenly on a metal screen cathode of the commercial size, due to the excellent suspension of asbestos fibers in the suspension medium. Furthermore, diaphragms prepared are satisfactorily utilized in the practical operation of electrolysis cells. In order to disclose more clearly these characteristics of the present invention, the following examples illustrating the invention are given.

EXAMPLE 1

Into a squarely shaped vessel of 100×50×200 cm were charged 750 l of an aqueous solution of hydroxyethyl cellulose having the concentration of 10 g/l, and 15 kg of asbestos fibers (Crysotile Grade 4T, Canadian Quebec Standard), and the contents were agitated thoroughly to obtain a suspension of asbestos fibers.

A polymer emulsion having the following characteristics was prepared:

Polymer composition: vinylfluoride/hexafluoropropylene=7/3

[$\eta$] in DMF at 30° C.: 0.60

Polymer concentration: 10%

Average particle size: 0.02$\mu$

To the suspension of asbestos fibers, 23 kg of the polymer emulsion was added, and agitated to obtain a slurry of asbestos fibers containing the polymer emulsion dispersed homogeneously.

A model metal screen cathode shown in FIG. 1 was used for deposition of asbestos fibers from the slurry. The cathode had two metal screens (1) of 100 (H)×50 (L)×3 (W) cm having the distance of 6 cm between them, and was equipped with an electrolyte collecting room (2) and a connection hose for vacuum (3). The cathode was immersed in the slurry, and the asbestos fibers were deposited on the cathode by means of effecting vacuum up to 300 mmHg gradually. During the deposition step, the cathode was occasionally pulled up from the slurry to tighten the deposited layer, and then immersed again until 150 l of the slurry was suctioned. Aspiration of air through the deposited layer of asbestos fibers was continued for 30 minutes with vacuum of 500 mmHg to obtain the layer of deposited asbestos fibers.

Figure 2:
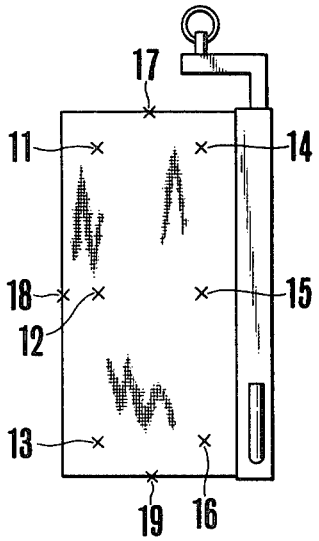
FIG. 2 is a view in side elevation of said model metal screen cathode indicating points for sampling of the deposited asbestos fibers.

For the layer of deposited asbestos fibers thus obtained, the amount of deposition of asbestos fibers on the cathode were checked at points (11–19) indicated in FIG. 2. The amount of asbestos fibers deposited at each point is as mentioned below, which indicates an even deposition of asbestos fibers on the metal screen cathode of commercial size.

| | Amount of asbestos fibers deposited on the screen, g/100 cm$^2$, dry basis | | |
|---|---|---|---|
| | | (Inside surface) | (Outside surface) |
| 11 | (10 cm from top; 10 cm from front) | 14.1 | 14.3 |
| 12 | (intermediate; 10 cm from front) | 13.8 | 14.4 |
| 13 | (10 cm from bottom; 10 cm from front) | 14.2 | 14.4 |
| 14 | (10 cm from top; 10 cm from root) | 13.1 | 14.4 |
| 15 | (intermediate; 10 cm from root) | 14.1 | 14.3 |
| 16 | (10 cm from bottom; 10 cm from root) | 13.5 | 14.6 |
| 17 | (center of top) | 13.9 | |
| 18 | (center of front) | 13.8 | |
| 19 | (center of bottom) | 15.0 | |

EXAMPLE 2

In the procedure of Example 1, the suspension medium of asbestos fibers was replaced with an aqueous solution of hydroxypropyl cellulose having the concentration of 2 g/l, and the deposition test of asbestos fibers identical with Example 1 was carried out. The result is as mentioned below, which indicates an even deposition of asbestos fibers on the metal screen cathode.

| | |
|---|---|
| Average amount of asbestos fibers deposited on inside surface of the screen (n = 6) | 13.8 g/100 cm$^2$ |
| Standard deviation of the above | 0.47 |
| Average amout of asbestos fibers deposited on outside surface of the screen (n = 6) | 14.4 |
| Standard deviation of the above | 0.12 |

EXAMPLE 3

In the procedure of Example 1, the suspension medium of asbestos fibers was replaced with an aqueous solution of methyl cellulose having the concentration of 2 g/l, and the deposition test of asbestos fibers indentical with Example 1 was carried out. The result is as mentioned below.

| | |
|---|---|
| Average amount of asbestos fibers deposited on inside surface of the screen (n = 6) | 13.5 g/100 cm$^2$ |
| Standard deviation of the above | 0.41 |
| Average amount of asbestos fibers deposited on outside surface of the screen (n = 6) | 14.0 |
| Standard deviation of the above | 0.11 |

EXAMPLE 4

In the procedure of Example 1, the suspension medium of asbestos fibers was replaced with an aqueous solution of high molecular weight polyethylene glycol (POLYOX WSR-N-750, Union Carbide Corp.) having the concentration of 10 g/l, and the deposition test of asbestos fibers identical with Example 1 was carried out. The result is as mentioned below.

| | |
|---|---|
| Average amount of asbestos fibers deposited on inside surface of the screen (n = 6) | 13.0 g/100 cm$^2$ |
| Standard deviation of the above | 0.63 |
| Average amount of asbestos fibers deposited on outside surface of the screen (n = 6) | 14.8 |
| Standard deviation of the above | 0.18 |

EXAMPLE 5

The asbestos slurry prepared in Example 1 was filtered by vacuum through a metal screen cathode of 10×10 cm to deposit about 3 mm layer of asbestos fibers on the screen. The layer of deposited asbestos fibers was dried at 90° C. for 2 hours to obtain a diaphragm of deposited asbestos fibers consolidated with a fluorinated polymer. With a vertical test cell for chlor-alkali electrolysis equipped with the diaphragm, electrolysis of brine was continued for about 3 months under conditions of brine concentration 310 g/l, brine depletion rate about 50%, electric current 20 A, and temperature 90° C. The result of electrolysis is as follows:

| | |
|---|---|
| Cell voltage | 3.2–3.4 V |
| Current efficiency | 93–99% |
| NaOH concentration | 125–145 g/l |

EXAMPLE 6

The asbestos slurry prepared in Example 2 was employed for obtaining a diaphragm of deposited asbestos fibers consolidated with a fluorinated polymer, and conducted an electrolysis test in the same way with Example 5. The result of electrolysis is as follows:

| | |
|---|---|
| Cell voltage | 3.2–3.4 V |
| Current efficiency | 93–99% |
| NaOH concentration | 125–145 g/l |

EXAMPLE 7

To 650 ml of aqueous solution of methyl cellulose having the concentration of 2 g/l, 13 g of the asbestos fibers were added, and agitated to obtain a slurry of asbestos fibers.

Into 145 ml of toluene was dissolved 30 g of polystyrene pellet. To the solution was added 2.7 ml of an emulsifier (nonylphenolether of polyoxyethylene) diluted with 145 ml of water. The mixture was agitated with a homogenizer to obtain a polystylene emulsion having the polymer concentration of 10%, and the average particle size of about 1μ.

Into the slurry of asbestos fibers, 30 g of the polymer emulsion was added, and a layer of asbestos fibers was prepared on the metal screen cathode in the same way as Example 5. The layer was washed with 100 ml of water and drained. The washed layer of asbestos fibers was dried at 50° C. for 2 hours, and a diaphragm of deposited asbestos fibers consolidated with polystyrene was obtained. Utilizing the diaphragm, an electrolysis test was conducted similarly to Example 5, and obtained the following result.

| | |
|---|---|
| Cell voltage | 3.2–3.6 V |
| Current efficiency | 93–97% |
| NaOH concentration | 120–130 g/l |

EXAMPLE 8

To 650 ml of aqueous solution of high molecular weight polyethylene glycol (POLYOX WSR-N-750) having the concentration of 10 g/l, 13 g of the asbestos fibers were added, and agitated to obtain a slurry of asbestos fibers.

Into 145 ml of chloroform was dissolved 30 g of polymethylmethacrylate pellet. To the solution was added 2.7 g ml of an emulsifier (nonylphenolether of polyoxyethylene) diluted with 145 ml of water. The mixture was agitated with a homogenizer to obtain a polyacrylate emulsion having the polymer concentration of 10%, and the average particle size of about 3μ.

Utilizing 30 g of the polymer emulsion, a diaphragm of deposited asbestos fibers consolidated with polyacrylate was prepared in the same procedure as Example 7. An electrolysis test was conducted similarly to Example 5, and the following result was obtained.

| | |
|---|---|
| Cell voltage | 3.3–3.7 V |
| Current efficiency | 93–96% |
| NaOH concentration | 120–130 g/l |

What is claimed is:

1. In a method of preparing diaphragms of deposited fibers consolidated by the use of a polymer emulsion comprising the steps of dispersing a polymer emulsion into asbestos fibers suspended in an aqueous suspension medium, and the step of depositing the polymer particles as well as the asbestos fibers on a metal screen cathode by means of filtration, the improvement wherein said suspension medium is an aqueous solution of a suspending agent selected from the group consisting of cellulose ethers, polyethylene glycol having a molecular weight of more than about 100,000 and polypropylene glycol having a molecular weight of from about 200 to about 700, there being from about 0.5 to about 10 g of suspending agent per liter of water, and drying the deposited particles and asbestos fibers at a temperature of under 100° C., whereby the polymer becomes adhesive and binds the asbestos fibers.

2. A method as claimed in claim 1, wherein said cellulose ether is hydroxyethyl cellulose, hydroxypropyl cellulose or methyl cellulose.

* * * * *

UNITED STATES PATENT AND TRADEMARK OFFICE

CERTIFICATE OF CORRECTION

PATENT NO. : 4,208,246

DATED : June 17, 1980

INVENTOR(S) : Shotaro Kiga et al.

It is certified that error appears in the above—identified patent and that said Letters Patent is hereby corrected as shown below:

On The Title Page Item (73) should read

-- (73) Assignee Nippon Soda Company Limited, Tokyo and Teijin Limited, Osaka, Japan --.

Signed and Sealed this

*Twenty-fourth* Day of *November 1981*

[SEAL]

*Attest:*

GERALD J. MOSSINGHOFF

*Attesting Officer*

*Commissioner of Patents and Trademarks*